United States Patent [19]

Latassa et al.

[11] Patent Number: 4,879,492

[45] Date of Patent: Nov. 7, 1989

[54] FLUORESCENT LAMP HAVING A MULTI-LAYER PHOSPHOR OPTIMIZED FOR LUMEN OUTPUT, COLOR RENDERING AND COST

[75] Inventors: Frank M. Latassa, Morgantown, W. Va.; William E. Wilson, Danvers, Mass.

[73] Assignee: North American Philips Corp., New York, N.Y.

[21] Appl. No.: 252,205

[22] Filed: Sep. 30, 1988

[51] Int. Cl.[4] ..... H01J 61/48

[52] U.S. Cl. ..... 313/487

[58] Field of Search ..... 313/485, 486, 487

[56] References Cited

U.S. PATENT DOCUMENTS 4,431,941 2/1984 Roy et al. ..... 313/487

*Primary Examiner*—Donald J. Yusko

*Assistant Examiner*—Sandra L. O'Shea

*Attorney, Agent, or Firm*—Emmanuel J. Lobato

[57] ABSTRACT

In a fluorescent lamp having a multi-layer phosphor, a halophosphate-containing layer having color coordinates within an oval centered on X=0.382 and Y=0.384. A rare earth activated phosphor layer has approximately the same color coordinates. The area density ratio of the rare earth and halophosphate-containing phosphor layers is between 0.088 to 0.222 and preferably between 0.088 to 0.133.

9 Claims, 1 Drawing Sheet

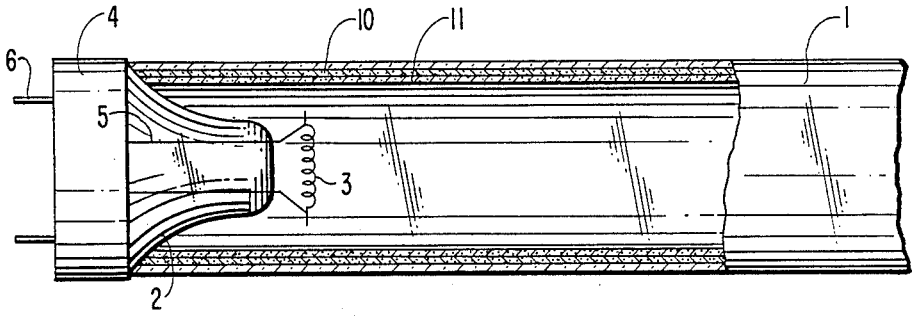
4
10
11
1
6
5
3
2

FLUORESCENT LAMP HAVING A MULTI-LAYER PHOSPHOR OPTIMIZED FOR LUMEN OUTPUT, COLOR RENDERING AND COST

BACKGROUND OF THE INVENTION

The present invention relates to fluorescent lamps having multi-layer phosphor coatings, and more particular to such lamps optimized with respect to lumen output, color rendering and cost.

Fluorescent lamps in which the fluorescent material is a halophosphate are well known, and such lamps have been highly developed. These lamps have the virtue of being relatively inexpensive, and at the same time having a good luminous efficacy and an acceptable color rendering index (CRI). The halophosphates are not suitable for use in small diameter fluorescent lamps in which the phosphor layer is close to the ionized mercury in the discharge stream.

The unit of lamp diameter is ⅛ inch. Conventional tubular fluorescent lamps have an outer diameter of 1.5 inches and are referred to as T12 lamps. In recent years, narrower diameter T10 lamps, and even T8 lamps have become increasingly popular. In these narrower diameter lamps the phosphor layer is closer to the discharge stream of mercury ions and degrades more quickly over time, thus shortening lamp life. Halophosphate phosphors are generally less satisfactory in T10 and T8 lamps than in T12 lamps.

Another class of phosphors having increasingly broad applications in recent years are the rare earth activated phosphors. Fluorescence in these phosphors is characterized by relatively narrow emission bands. A fluorescent lamp having a rare earth activated phosphor, with emission in the red, green and blue portions of the spectrum has the potential for achieving very good color rendering characteristics. Such a lamp is disclosed in U.S. Pat. No. 3,937,998 (Verstegen et al), and can readily achieve CRI values in excess of 80.

Rare earth activated phosphors, such as aluminates, also have high luminous efficacy. Moreover, these phosphors readily withstand the mercury ion discharge stream in fluorescent lamps. They are thus suitable for narrow diameter fluorescent lamps, even narrower than T8. A disadvantage of such phosphors is that they are relatively expensive.

Lamps having both halophosphate phosphors and rare earth activated phosphors are also known. In these lamps, the halophosphate phosphor is disposed directly on the lamp envelope, and then an overlying rare earth activated phosphor layer is disposed on the halophosphate. If the rare earth activated phosphor is of a type that can withstand interaction with mercury ions better than the halophosphate, for example the aluminates, the rare earth activated phosphor layer may act as a protective covering to reduce halophosphate degradation. In addition, the rare earth phosphors result in lamps having a higher CRI than lamps made with just a halophosphate.

An example of such a multi-layer phosphor lamp is disclosed in U.S. Pat. No. 4,751,426 (Hoffman et al). That patent discloses a fluorescent lamp having a halophosphate layer which emits light having a color temperature falling within the standard cool white oval of the CIE chromaticity diagram. A second layer of rare earth activated phosphors covers the halophosphate layer and improves the CRI of the light emitted by the lamp.

It would be desirable to minimize the amount of rare earth activated phosphor in the lamp in order to reduce cost. The amount of rare earth phosphor can not be reduced arbitrarily, however, or the lamp CRI may be unacceptably low. Additionally, the rare earth activated phosphor must form a continuous layer covering the halophosphate. This is especially important in smaller diameter lamps because a function of the rare earth activated phosphor layer is to protect the underlying halophosphate layer from degradation by the mercury ion stream.

Accordingly, it is an object of the invention to provide a multi-layered fluorescent lamp having an acceptable CRI and optimized to maximize lamp efficacy and lower cost.

SUMMARY OF THE INVENTION

According to the invention, a fluorescent lamp is comprised of a first layer of a Lite White phosphor blend having color coordinates on the CIE chromaticity diagram within a MacAdam four step oval centered on X=0.382 and Y=0.384. The lamp according to the invention further comprises a second layer of a mixture of rare earth activated phosphors having approximately the same X and Y color coordinates within the CIE chromaticity diagram as the first layer of phosphor. The rare earth activated phosphor mixture is disposed in a layer substantially covering the first layer phosphor blend and having a minimum area density of approximately 2.70 milligrams per square inch and a maximum area density of approximately 5.40 milligrams per square inch. The lamp has a CRI value equal to at least 60, and an efficacy of about 87 lumens per watt.

The ratio R of the area density of the rare earth activated phosphor mixture to the area density of the first layer phosphor blend is between approximately 0.088 to approximately 0.220. In a preferred embodiment the area density ratio is between approximately 0.088 to approximately 0.133.

BRIEF DESCRIPTION OF THE DRAWING

The accompanying drawing illustrates a partial section of a fluorescent lamp according to the invention having a multi-layered phosphor.

DETAILED DESCRIPTION OF THE INVENTION

The fluorescent lamp according to the invention shown in the drawing is comprised of an outer envelope 1 having a pair of opposite sealed ends, only one of which is shown. Each end is closed by a sealed reentrant stem 2 on which a thermionic electrode 3 is mounted. A lamp base 4 covers the sealed end of the envelope 1. A pair of conductive leads 5 extend through the sealed reentrant stem and are connected to respective pins 6 which are mounted on the lamp base 4 and insulated from each other.

The lamp has an internal fluorescent material Which is excited by ultraviolet radiation to emit light. The interior of the lamp is charged with a small quantity of mercury which is vaporized and ionized during lamp operation in order to generate the ultraviolet radiation, and an inert starting gas such as argon at a pressure of 1.5 to 5.0 torr for initiating vaporization of the mercury.

The phosphor is disposed on the inner surface of the lamp envelope 1 in a first layer 10 and a second layer 11.

The first phosphor layer 10 is a Lite White phosphor blend containing a halophosphate phosphor and the second phosphor layer 11 is a mixture of rare earth activated phosphors. Both phosphor layers have approximately the same X and Y color coordinates on the CIE chromaticity diagram. The rare earth activated phosphor mixture not only emits light in response to the ultraviolet radiation, but also acts as a protective layer for the underlying halophosphate-containing layer.

The phosphor blend of the first layer emits light having a color temperature within a MacAdam four step oval centered on CIE color coordinates X=0.382, Y=0.384. Preferably, the Y color coordinate is held between 0.38 and 0.39.

The first phosphor layer 10 is a blend of a yellow emitting phosphor and a blue emitting phosphor. In the preferred embodiment the yellow emitting phosphor is calcium fluorophosphate: $Sb^{+3}$, $Mn^{+2}$ having a composition $Ca_{9.45}(PO_4)Sb_{0.01}$, $Mn_{0.38}$ with a crystal lattice structure of calcium apatite. The phosphor has CIE color coordinates x=0.405, y=0.429. The blue emitting phosphor may be another halophosphate; europium-activated strontium chlorophosphate. In the examples of the invention described below the blue emitting phosphor was europium-activated barium magnesium aluminate phosphor. The phosphor blend is typically 95 to 96% of the yellow emitting phosphor and 4 to 5% by weight of the blue emitting phosphor.

The second phosphor layer 11 is comprised of three different phosphor components each of which emits a respective color band; red, yellow-green and blue. The red emitting component is trivalent europium-activated yttrium oxide. The yellow-green emitting component is terbium and cerium-coactivated magnesium aluminate phosphor. The blue emitting component is divalent europium-activated barium magnesium aluminate phosphor.

The three components of the second phosphor layer 11 are combined in weight proportions such that the X, Y color coordinates of the second phosphor layer are approximately equal to the color coordinates of the first phosphor layer 10. Because of the three different color components of the light emitted from the second phosphor layer, the color rendering index of the light from the lamp will be higher than that of a lamp having just halophosphate phosphors.

The relative amounts of rare earth phosphor and halophosphate phosphor have a substantial impact on lamp cost and lamp CRI, as well as affecting other lamp parameters. A convenient measure of the amount of phosphor is the phosphor area density, expressed in milligrams per square inch (mg/in$^2$). In the lamp according to the invention, the second layer is deposited with a minimum area density of about 2.7 milligrams per square inch. This is approximately the minimum area density that will uniformly cover the underlying halophosphate-containing layer. Moreover, the mass ratio R between the rare earth phosphor and the halophosphate-containing phosphor blend is in the range from about 0.088 to about 0.220. These relative proportions of rare earth phosphor and halophosphate-containing blend result in a lamp having a CRI equal to at least that of a standard cool white fluorescent lamp (CRI=62) and having a greater lumen output efficacy, at a substantially lower cost than standard double coated lamps.

The improvements realized by the present invention can be appreciated by reference to the table below, in which lamp 1 is a standard cool white fluorescent lamp, and lamp 2 is made with just the particular Lite White phosphor blend used in the present invention. Lamps 3 and 4 are two different embodiments of the invention. Lamp 5 is Example 1 of the Hoffman et al U.S. Pat. No. 4,751,426, and lamp 6 is a standard double layer fluorescent lamp. All of the lamps were rated at 40 watts and had a 48 inch long tubular envelope.

| lamp | lumens | eff. (m/w) | R | CRI | relative cost | size | color temp |
|---|---|---|---|---|---|---|---|
| 1 | 3200 | 80.0 | — | 62 | 100% | T10 | 4100 |
| 2 | 3350 | 83.8 | — | 50 | 105% | T10 | 4100 |
| 3 | 3500 | 87.5 | 0.11 | 62 | 130% | T10 | 4100 |
| 4 | 3520 | 88.0 | 0.22 | 72 | 148% | T10 | 4100 |
| 5 | 3495 | 87.4 | 0.40 | 73 | 177% | T12 | 4100 |
| 6 | 3450 | 86.3 | 0.78 | 80 | 200% | T10 | 4100 |

A conventional cool white fluorescent lamp (1) provides the standard of comparison. It provides good lumen output at 3200 lumens, a good efficacy of 80 lumens per watt and an acceptable CRI of 62. Lamp 2, made with just the Lite White phosphor blend used in the invention herein, achieves a substantial improvement in lumen output and efficacy at an acceptable cost, but the CRI decreases markedly. The object of the invention is to achieve at least the same CRI as the conventional cool white lamp with greater lumen output and improved efficacy, and at an acceptable cost.

The first embodiment of the invention (lamp 3) does this by using a rare earth phosphor layer having a density of approximately 2.7 mg/in$^2$. The second embodiment (lamp 4) has the rare earth phosphor disposed at a density of approximately 5.4 mg/in$^2$ and obtains a higher CRI, but at a greater cost. Lamp 5 is Example 1 of the Hoffman et al U.S. Pat. No. 4,751,426 and also achieves a high CRI, but at the price of a substantially higher amount of rare earth phosphor and without any gain in lumens. Lamp 6, a conventional double layered lamp, has the highest CRI value but has a lower lumen output and is less efficient than the invention. Moreover, it is twice as expensive as the standard cool white lamp (1).

The specific embodiments of the invention described were made with straight lamp envelopes. The claimed invention is equally applicable to curved lamp envelopes such as those in U-bent or circular lamps. Moreover, other lamp components may be added such as a conductive inner layer for a starting aid, and electrode cut-out switches to save energy. These and other modifications are within the scope of the present invention which is defined by the following claims.

What is claimed is:

1. In a fluorescent lamp having a phosphor excited during lamp operation to emit visible light, the improvement comprising:

a first layer comprising a halophosphate phosphor having CIE color coordinates within a four step MacAdam oval centered on X=0.382 and Y=0.384 and exterior to the standard cool white oval;

a second layer of a rare earth activated phosphor having approximately the same color coordinates as said first layer of phosphor and disposed with an area density of at least approximately 2.7 milligrams per square inch and covering said first layer of phosphor;

the ratio of the area density of the rare earth activated phosphor to the area density of the halophosphate-containing phosphor being between 0.088 to 0.222; and the lamp having a color rendering index equal to at least 60.

2. In a fluorescent lamp according to claim 1, wherein the ratio of the area density of the rare earth activated phosphor to the area density of the halophosphate-containing phosphor is between approximately 0.088 to approximately 0.133.

3. In a fluorescent lamp according to claim 2, wherein the area density of the rare earth activated phosphor is approximately 2.7 milligrams per square inch.

4. In a fluorescent lamp according to claim 1, wherein the ratio of area density of the rare earth activated phosphor to the area density of the halophosphate-containing phosphor is approximately 0.11.

5. In a fluorescent lamp according to claim 4, wherein the area density of the rare earth activated phosphor is approximately 2.7 milligrams per square inch.

6. In a fluorescent lamp according to claim 1, wherein the area density of the rare earth activated phosphor is between approximately 2.7 and 5.4 milligrams per square inch.

7. In a fluorescent lamp according to claim 1, wherein the halophosphate phosphor is a blend of antimony and manganese co-activated calcium fluorophosphate and a blue emitting phosphor.

8. In a fluorescent lamp according to claim 6, wherein the halophosphate has a Y color coordinate between 0.38 and 0.39.

9. In a fluorescent lamp according to claim 1, wherein the halophosphate has a Y color coordinate between 0.38 and 0.39.

* * * * *